United States Patent [19]

Alias et al.

[11] Patent Number: 4,671,214

[45] Date of Patent: Jun. 9, 1987

[54] HEAT EXCHANGER DEVICE FOR DRYING AND SUPERHEATING STEAM

[75] Inventors: Pascal Alias, Massy; Olivier Lacoste, Boulogne Billancourt; Jacques Marjollet, Paris; Pierre Poudéroux, Meudon La Foret, all of France

[73] Assignee: Stein Industrie, Velizy-Villacoublay, France

[21] Appl. No.: 842,620

[22] Filed: Mar. 21, 1986

[30] Foreign Application Priority Data

Mar. 22, 1985 [FR] France ..... 85 04300

[51] Int. Cl.[4] ..... F22B 37/26

[52] U.S. Cl. ..... 122/488; 55/462; 122/483; 122/491

[58] Field of Search ..... 122/459, 460, 469, 476, 122/478, 479 D, 483, 488, 489, 491; 165/110, 159, 160, 161; 55/462, 463, 465

[56] References Cited

U.S. PATENT DOCUMENTS

| | | | |
|---|---|---|---|
| 1,177,793 | 4/1916 | Mims | 122/469 X |
| 3,532,160 | 10/1970 | Garrison | 165/159 |
| 4,123,237 | 10/1978 | Zipay et al. | 122/491 X |
| 4,250,841 | 2/1981 | Bessouat et al. | 122/483 |
| 4,278,053 | 7/1981 | Bessouat et al. | 122/488 |
| 4,302,227 | 11/1981 | Miller | 122/488 X |
| 4,589,893 | 5/1986 | Franzolini et al. | 122/483 X |

FOREIGN PATENT DOCUMENTS

| | | | |
|---|---|---|---|
| 1579779 | 8/1969 | France | 122/483 |

*Primary Examiner*—Henry C. Yuen
*Assistant Examiner*—Steven E. Warner
*Attorney, Agent, or Firm*—Sughrue, Mion, Zinn, Macpeak and Seas

[57] ABSTRACT

A heat exchanger device for drying and then superheating steam, has a cylindrical casing about a horizontal axis. The casing contains:

(a) a bottom admission chamber for wet steam;

(b) intermediate separator members (7, 8, 9, 10, 21) for removing water from the wet steam;

(c) a top bundle of superheater tubes (11); and (d) wet steam flow channels (15, 17) located on either side of the bundles of superheater tubes. These channels are separated from the admission chamber by a partition (19) extending from one only of the sides of the superheaters in such a manner as to ensure that the wet steam rises in the vicinity of the inside surface of the casing round one side only of the superheaters and then descends round the other side towards the inlet to the separator members (21).

2 Claims, 1 Drawing Figure

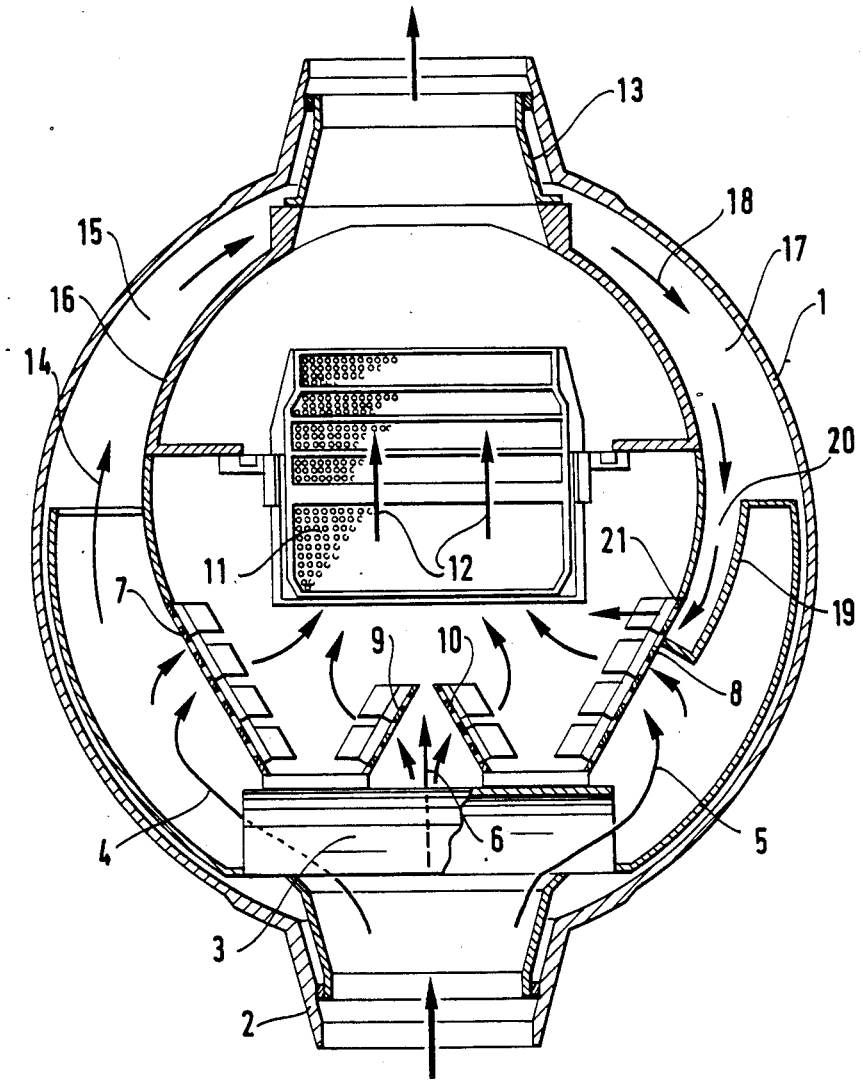
13
18
17
1
15
16
14
20
21
19
11
12
7
9
10
8
4
6
5
3
2

HEAT EXCHANGER DEVICE FOR DRYING AND SUPERHEATING STEAM

FIELD OF THE INVENTION

The present invention relates to a heat exchanger device for drying and then superheating steam, in particular for supplying steam to an expansion turbine, said device having a horizontal axis and comprising a cylindrical casing disposed parallel to said axis and symmetrically about a longitudinal plane of symmetry, said casing containing:

(a) an admission chamber for wet steam to be dried and superheated, said admission chamber being located in the lower portion of said casing;

(b) separator members for removing water from the wet steam to be superheated, said separator members being located above aid admission chamber;

(c) a bundle of superheater tubes located in the top of said casing, superheated steam under pressure being passed along said tubes to be cooled therein and then condensed, thereby exchanging heat with the dried steam to be superheated; and (d) wet steam flow channels located on either side of the bundles of superheater tubes to enable a portion of the wet steam to rise adjacent to the inside surface of said casing prior to returning towards said separator members.

BACKGROUND OF THE INVENTION

The Applicants' European patent EP-B-005225(U.S. Pat. No. 4,250,841) relates to a device of this kind, in which the channels enable the wet steam to rise on either side of the superheaters in the vicinity of the inside surface of the casing, and then to descend between two groups of superheaters to arrive at the inlet to the separators in the vicinity of the plane of symmetry.

This device requires the superheaters to be divided into two separate groups leaving a oentral space through which the wet steam to descends. This increases the diameter of the device, thereby increasing its overall bulk and its cost.

Preferred embodiments of the present invention provide a device for drying and superheating steam, with the device being of smaller bulk and weight than the above-specified prior device, while still cooling of the inside wall of the casing just as effectively.

SUMMARY OF THE INVENTION

The device in accordance with the invention includes the improvement whereby its wet steam circulation channels are separated from the admission chamber by a partition extending from one only of the sides of the superheaters in such a manner as to ensure that the wet steam rises in the vicinity of the inside surface of the casing round one side only of the superheaters and then descends round the other side towards the inlet to the separator members.

BRIEF DESCRIPTION OF THE DRAWING

An embodiment of a device for drying and superheating steam in accordance with the invention is described below with reference to the sole FIGURE of the accompanying drawing. This device forms a part of an installation for producing energy by allowing steam to expand through turbines.

The FIGURE shows the device in section on a plane perpendicular to its axis and through a wet steam inlet tube and a superheated steam outlet tube.

MORE DETAILED DESCRIPTION

The device comprises an outer casing 1 fitted with a plurality of admission tubes such as 2 for admitting wet steam (an emulsion of water and steam).

A distribution member 3 of the kind described in the Applicants' French patent FR-B-2442069 (U.S. Pat. No. 4,278,053) is located above such a tube 2 in order to split the incoming wet steam into two sideways flows represented by arrows 4 and 5, and into an axial flow represented by arrow 6. A first portion of the left-hand sideways flow 4 penetrates through the blocks of separator members 7 which may be constituted, for example, by stacks of parallel corrugated baffle sheets on which drops of water are deposited, which drops then run along the sheets prior to being evacuated via gutters and evacuation pipes (not shown).

The right-hand sideways flow of wet steam as represented by arrow 5 passes through blocks of separator members 8. The axial flow as represented by arrow 6 passes through blocks of separator members 9 and 10. The dried steam coming from the various blocks of separator members plus a further fraction of dried steam used for cooling the casing in a manner described below then rises towards the superheat exchangers 11 which are constituted by bundles of tubes having higher pressure steam flowing there along. The steam being superheated passes through these heat exchangers and shown by arrows 12 and is delivered to the end use via outlet tubes such as 13.

A second portion of the left-hand flow of wet steam 4 does not pass directly through the separator members, but rises round the inside wall of the casing 1 as shown by arrow 14, with a channel 15 being disposed between the casing 1 and an internal envelope 16 which delimits the flow of steam being superheated. This second portion of wet steam keeps the casing 1 to a relatively low temperature. It subsequently descends round the other side of the internal envelope 16 via a channel 17 disposed along the right-hand side of the casing 1, as represented by arrow 18. This second portion is then directed by means of a partition 19 into a channel 20 leading to an inlet to separator members 21 where any residual water is removed. This fraction of dried steam then continues with the remainder of the dried steam and is superheated therewith.

We claim:

1. In a heat exchanger device for drying and then superheating steam, in particular for supplying steam to an expansion turbine, said device having a horizontal axis and comprising a cylindrical casing having an inside surface and being disposed parallel to said axis and symmetrically about a longitudinal plane of symmetry, having an upper portion and a lower portion, and said casing containing:

(a) an admission chamber for wet steam to be dried and superheated, said admission chamber being located in the lower portion of said casing;

(b) separator members for removing water from the wet steam to be superheated, said separator members being located above said admission chamber;

(c) a bundle of superheater tubes located in the upper portion of said casing, superheated steam under pressure being passed through said tubes to be cooled therein and then condensed, thereby exchanging heat with the dried steam to be superheated; and (d) wet steam flow channels located on either side of the bundles of superheater tubes to enable a portion of the wet steam to rise adjacent to the inside surface of said casing prior to returning towards said separator members;

the improvement comprising a partition separating said wet steam flow channels from the admission chamber, said partition extending from one only of the sides of the superheaters in such a manner as to ensure that the wet steam rises in the vicinity of the inside surface of the casing round one side only of the superheaters and then descends round the other side towards the inlet to the separator members.

2. A heat exchanger device as claimed in claim 1, wherein a cylindrical internal envelope 16 is positioned between said casing and said bundle of superheater tubes and being spaced from said casing to partially define said wet steam flow channels and is extended at the bottom thereof by said separator members for removing water from the wet steam to be superheated to opposite sides of said bundle of superheater tube, wherein said partition extending from one only of the sides of the superheaters connects to said separator members on that side at a position such that wet steam entering said admission chamber has a first portion flowing into said upper portion of the casing beneath said partition through a portion of said separator members below said partition to that side, a second portion of said wet steam enters said upper chamber through said separator members to the opposite side of said bundle of superheater tubes with some of said second portion of wet steam, rising in the vicinity of the inside surface of the casing around the side of the superheater tubes opposite the side bearing said partition and then descends around the other side towards the inlet to the separator members above said partition whereby, part of the split incoming wet steam flow in passing over the outer surface over the exterior of said internal envelope maintains the casing at a relatively low temperature prior to entering said separator member above said partition with this part of the steam being dried and passed through said bundle of superheater tubes to be superheated thereby.

* * * * *